US012152386B2

(12) United States Patent
Burmeister et al.

(10) Patent No.: US 12,152,386 B2
(45) Date of Patent: Nov. 26, 2024

(54) CONSOLE FOR RETRACTABLE ROOFS AND FACADES

(71) Applicant: Delta-X GmbH Ingenieurgesellschaft, Stuttgart (DE)

(72) Inventors: Albrecht Burmeister, Weissach im Tal (DE); Lutz Eitel, Esslingen (DE); Michael Keefer, Weinstadt (DE)

(73) Assignee: Delta-X GmbH Ingenieurgesellschaft, Stuttgart (DE)

( * ) Notice: Subject to any disclaimer, the term of this patent is extended or adjusted under 35 U.S.C. 154(b) by 0 days.

(21) Appl. No.: 18/684,211

(22) PCT Filed: Aug. 12, 2022

(86) PCT No.: PCT/EP2022/072705
§ 371 (c)(1),
(2) Date: Feb. 16, 2024

(87) PCT Pub. No.: WO2023/020973
PCT Pub. Date: Feb. 23, 2023

(65) Prior Publication Data

US 2024/0263446 A1 Aug. 8, 2024

(30) Foreign Application Priority Data

Aug. 16, 2021 (DE) ..... 10 2021 121 248.0

(51) Int. Cl.
*E04B 7/16* (2006.01)

(52) U.S. Cl.
CPC ..... *E04B 7/166* (2013.01)

(58) Field of Classification Search
CPC ..... E04B 7/16; E04B 7/166; E04H 3/165
See application file for complete search history.

(56) References Cited

U.S. PATENT DOCUMENTS

| | | | | |
|---|---|---|---|---|
| 5,189,851 | A | 3/1993 | Omika et al. | |
| 5,896,708 | A * | 4/1999 | Doi | E04B 7/166 52/66 |
| 2002/0129565 | A1 * | 9/2002 | Silberman | E04H 3/14 52/66 |
| 2020/0181900 | A1 | 6/2020 | Fedor | |

FOREIGN PATENT DOCUMENTS

| | | | | |
|---|---|---|---|---|
| CN | 101230687 | A | 7/2008 | |
| DE | 202012100158 | U1 * | 4/2012 | E04B 7/166 |
| DE | 102011120071 | A1 * | 6/2013 | E04B 7/166 |
| WO | 2023020973 | A1 | 2/2023 | |

OTHER PUBLICATIONS

Translated German Examination Report, Application No. 102021121248.0, dated Jul. 6, 2022, pp. 1-14.
Translated International Search Report, Application No. PCT/EP2022/072705, prepared Oct. 24, 2022, mailed Nov. 4, 2022, pp. 1-5.
CA Office Action, Application No. 3227647, dated May 31, 2024, entire document.

* cited by examiner

*Primary Examiner* — Christine T Cajilig
(74) *Attorney, Agent, or Firm* — George R. McGuire; Bond Schoeneck & King PLLC

(57) ABSTRACT

The invention relates to a console with the aid of which large roofs and facade elements can be horizontally or vertically retracted.

8 Claims, 9 Drawing Sheets

Ansicht 1 - 1

Ansicht 3 - 3

CONSOLE FOR RETRACTABLE ROOFS AND FACADES

CROSS-REFERENCE TO RELATED APPLICATION

The present application is the United States National Stage Application, filed under 37 U.S.C. 371, of International Patent Application No. PCT/EP2022/072705, filed on Aug. 12, 2022, which claims priority to German patent application no. 10 2021 121 248.0 filed Aug. 16, 2021, the entire contents of each of which is hereby incorporated by reference.

In many recreational facilities, such as thermal baths, so-called water parks, soccer stadiums, tennis halls, or cruise ships, it is desirable to perform recreational and sports activities outdoors. If the weather is poor, these recreational activities should be protected from weather and be executed under comfortable external conditions. This is possible if the roof and/or parts of the facade of the thermal baths, bathing facilities, tennis courts, or soccer stadiums are retractable. The roof and/or the facade can then be pushed "to the side" as required, so that sunlight and fresh air can reach the interior of the building. If the weather worsens or temperatures are too low, the roof and/or the facade are moved again over or in front of the building.

However, a retractable roof or facade can also be used in order to quickly and safely let smoke out of the space underneath in the event of a fire. In industrial plants, it can also be advantageous if the roof or parts of the facade can be moved—for example, in order to lift large machines or workpieces into a hall.

Atria and courtyards are also typical applications for retractable roofs, and also in view of the fact that, by means of such retractable roofs or facades, energy savings, more favorable air conditioning, etc., can be achieved for the buildings surrounding the atrium/courtyard.

Considerable wind forces, rain or snow loads, and/or gravitational forces act upon these retractable roofs or facades (or parts thereof), which forces must be safely applied to the support structure of the building in any position and under all conceivable circumstances. In addition, increasingly higher demands on the aesthetics and design are also imposed on the aforementioned recreational facilities. In the following, for linguistic simplification, usually only roofs or a retractable component are spoken of, which, however, always mean roofs and facades or parts thereof.

From later published DE 10 2020 122 733 A1, a console is known which shares similarities with the console according to the invention.

The object of the invention is to provide a console for retractable roofs and facades which fulfills the functional and safety requirements with regard to precise and secure guidance of the roofs and facade parts to be moved. Furthermore, they shall enable an architecturally appealing design of a building provided with a retractable roof and/or retractable facade elements.

Finally, tensions between the console and a linear guide are to be minimized in order to lengthen the service life of the linear guide or to reduce the load thereon.

This object is achieved according to the invention by a console for retractable roofs and facades, comprising two load application plates, a connection plate, and a mechanical interface, wherein the connection plate is connected to one of the load application plates by means of a respective rotary bearing, wherein the mechanical interface comprises at least one first bearing plate with a bearing bore and at least one second bearing plate arranged on the connection plate with a bearing bore and a bearing pin, wherein an axis of rotation of the rotary bearing formed by the bearing bores and the bearing pin runs parallel to a direction of travel (X-direction) of the console. The mechanical interface establishes the connection of roof or facade and the console according to the invention.

In the console according to the invention, there is accordingly a total of three rotary bearings. A rotary bearing is formed between the connection plate and a first load application plate. A further rotary bearing is formed between the connection plate and a second load application plate. The axes of rotation of the first and second rotary bearings run parallel to one another. In general, they run in the vertical direction when the console bears a retractable roof. As a rule, they run in the horizontal direction when the console bears a facade.

The third rotary bearing is formed between a bearing plate, which is connected directly or indirectly to the retractable roof or the facade, and the connection plate. The axis of rotation of the third rotary bearing runs parallel to a direction of travel (X-direction) of the console and generally orthogonally to the axes of rotation of the first and second rotary bearings.

The design according to the invention is very advantageous, for, among others, the following reasons:

The loads of the roof or facade are distributed from the connection plate onto two carriages. This reduces the load on the carriage by about 50%. However, the local loading of the guide rail is also reduced, because the forces to be transmitted are introduced into the guide rail at several points (corresponding to the distance of the carriages from one another), so that the local loads of the guide rail and the structure bearing them are likewise significantly reduced. This allows a slim, aesthetically pleasing design, and reduces the use of material without compromising safety.

Of course, the use of several carriages also ensures the security against failure. If, namely, a carriage or a roller bearing of one of the carriages fails, the other carriage can absorb the loads at least until the roof or the facade element is closed. The operational safety of the retractable roof or facade element is thereby ensured.

The first and second rotary bearings enable the carriage to follow the course of the guide rail when the latter deviates somewhat from its ideal shape of a straight line—for example, due to thermal expansion.

As a result, tensions within the console or between roof and support are largely avoided in the console according to the invention. Such tensions are caused, for example, by differences in temperature-induced expansion between the roof/facade and the structures (buildings) bearing them.

Especially in the case of large roofs with a span of more than 30 meters (30 m), such strains can lead to considerable internal forces within the consoles. These internal forces also stress the bearing of a linear guide on which the carriages of the console are guided.

The loads of the roof or facade are introduced into the connection plate via the third rotary bearing, so that no tilting moments or only very small tilting moments occur, whose axis of rotation runs parallel to the direction of travel of the console. This also relieves the linear guide between carriage or console and a guide rail arranged on the building.

In addition, linear guides can also be used for very large roofs, which linear guides are available on the market and actually originate from the field of machine tools.

In an advantageous embodiment of the invention, the first and the second rotary bearings are each formed by a bearing pin and a recess interacting with the bearing pin. As a rule, due to the advantageous use of space, the pins are arranged on the load application plates, and the recesses are arranged on the connection plate. However, this is not mandatory; the "reversed" arrangement is also possible.

In a further embodiment, the connection plate has a recess approximately in its center. The at least one second bearing plate is arranged on the connection plate such that the bearing bore(s) is/are positioned beneath the connection plate. The relative term, "beneath," is to be understood such that the third rotary bearing is positioned as close as possible to and approximately at the height of the guide rail. The term, "beneath," is to be understood literally, when the console, as shown in FIGS. 7 through 9, bears a roof and can be moved in the horizontal direction.

The arrangement of the axis of rotation beneath the connection plate avoids or minimizes tilting moments, which can act upon the carriages and whose axis of rotation runs parallel to the direction of travel of the console. As a result, the rolling elements between guide rail and carriage are less loaded, which increases their service life and load-bearing capacity. The same also applies to the transmission of horizontal loads from the second bearing plate to the guide rail. For example, in a rolling bearing with cylindrical rollers as rolling elements, the rollers are loaded uniformly over their entire length; local overloads of individual roller bodies do not occur, which has a positive effect on the running smoothness and the service life of the linear guide.

In order to improve the bending stiffness and torsional stiffness of the console, a reinforcement is provided on the upper side of the connection plate. The at least one second bearing plate is preferably connected to the reinforcement.

At its end opposite the bearing bore, the at least one first bearing plate is connected to a support or a flange plate. The support is part of the roof structure of the retractable roof or facade.

In an advantageous embodiment, the connection plate comprises two side surfaces, wherein at least one retaining part is releasably fastened to the side surfaces, which retaining part surrounds the load application plates of the carriages. In addition to the rotary bearings, a positive connection, generally provided with sufficient play, is thereby created between the connection plate and the carriage. This positive connection not only establishes a redundant connection and thereby increases the safety of the console; it also prevents the lifting of the roof in the event of a storm or hurricane gusts.

In order to be able to connect the mechanical interface to a retractable roof or a retractable facade, it has, in a preferred embodiment, one or more flange plates. These flange plates can, for example, be connected to supports of the roof or the retractable facade by screws, so that the mechanical interface can be produced independently of the roof or the facade element. Via the flange plates, the mechanical interface can be connected to various roofs and facade elements without requiring design changes to the console according to the invention.

In a further advantageous embodiment, the load application plate is part of a linear guide, wherein the linear guide comprises a guide rail. The guide rail is directly or indirectly connected to a support structure of a building.

The load application plates are preferably arranged on carriages or integrated therein. The carriages in turn are guided on the guide rail.

In a preferred development, it is possible for the carriages and the guide rail to be a linear or roller guide available on the market. These roller guides are generally provided for use in machines or other systems. With the aid of the console according to the invention, they can also be used for moving roofs and/or facade elements. Because these roller guides are industrial products manufactured in series, they are available in a very high quality. In addition, the costs are relatively low compared to a single production.

The guide rails available on the market generally comprise a base, which is the region with which the guide rail is screwed, for example, to a machine foundation, and a bearing region.

This bearing region is a part of the rolling or sliding bearing between the carriage and the guide rail. In the case of roller-mounted linear guides, the bearing region is usually designed as "tapered." It has the shape of an "X" in cross-section. The forces between the carriage and the guide rail are transmitted via the guide surfaces of the bearing region. Since such guide rails or linear guides are available on the market, they are known to a person skilled in the art, and a detailed description is omitted.

The guide rail can be fastened directly or indirectly to a support structure of a building. This can be achieved by means of clamping elements, for example.

If the guide rail is not rigid enough—in particular, for receiving lateral loads—the guide rail can be arranged on a support rail, and in particular can be screwed thereto. Ideally, a groove is provided in the support rail, into which groove the base of the guide rail is inserted. This results—especially in the horizontal direction—in a positive connection between the support rail and the guide rail. The bending stiffness of the guide rail is thereby significantly increased. Guide rails available on the market can thereby be "upgraded" for absorbing large lateral forces. This also significantly increases the range of applications of linear guides on the market, without reducing the safety and service life of the linear guide.

Further advantages and advantageous embodiments of the invention can be found in the following drawings, the description, and the claims.

DRAWINGS

DESCRIPTION OF THE EXEMPLARY EMBODIMENTS

Figure 1:
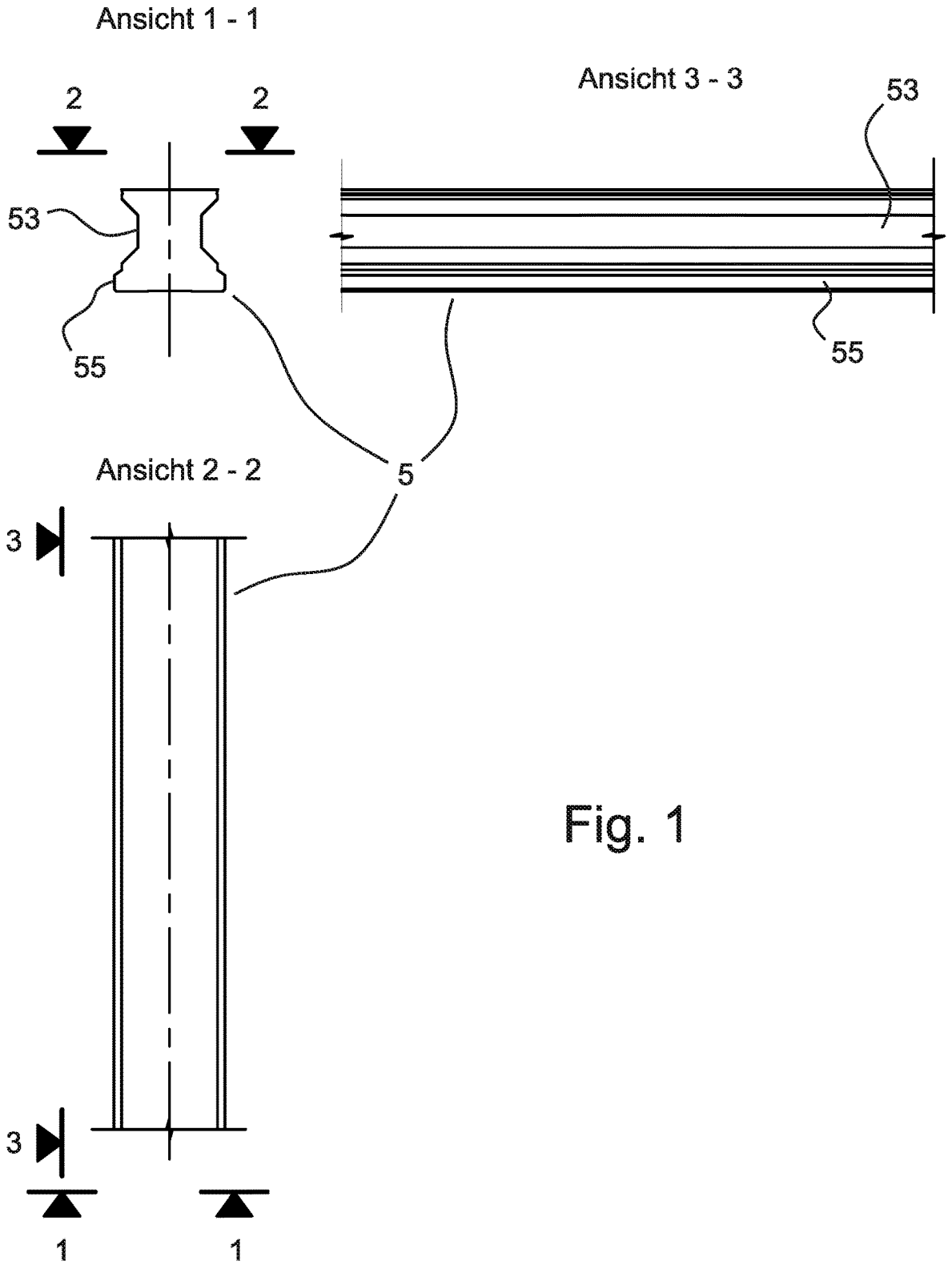
FIG. 1 shows a guide rail.

The same reference signs are used in all figures. A guide rail 5 is shown in various views in FIG. 1. The "tapered" region of the guide rail 5 in cross-section is the so-called bearing region 53. The base 55 serves to connect the guide rail 5 to a supporting structure 13 (see FIG. 7).

Figure 2:
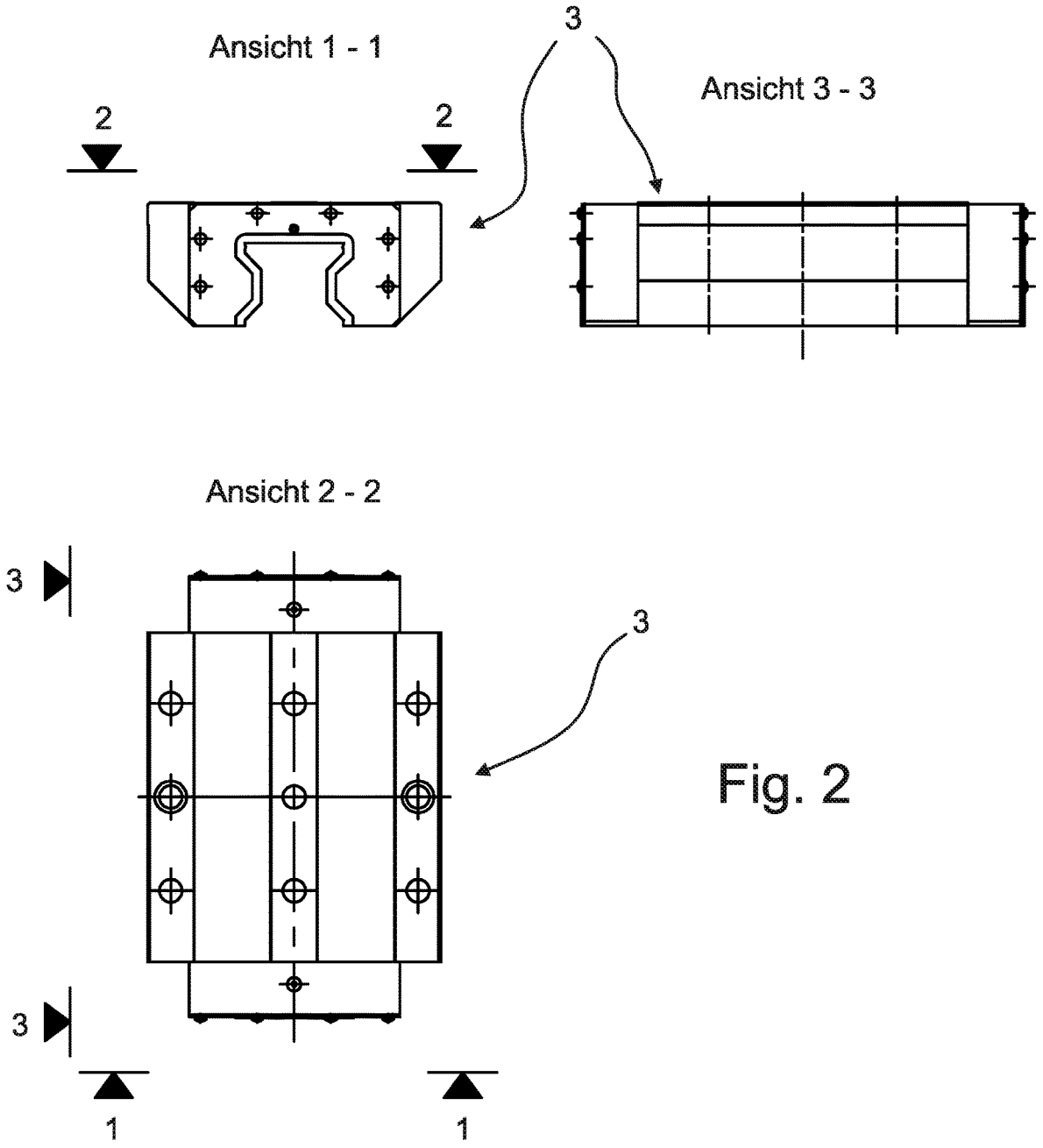
FIG. 2 shows a roller carriage for heavy loads.

A carriage 3 is shown in various views in FIG. 2. Several threaded bores (without reference signs) are present on the upper side of the carriage 3 (see view 2-2). With the aid of these threaded bores, a load application plate 15 (see FIG. 3) of the console 1 according to the invention is releasably connected to the carriage 3.

In the embodiment shown, two carriages 3 are present, and, accordingly, two load application plates 15 are also provided.

Figure 7:
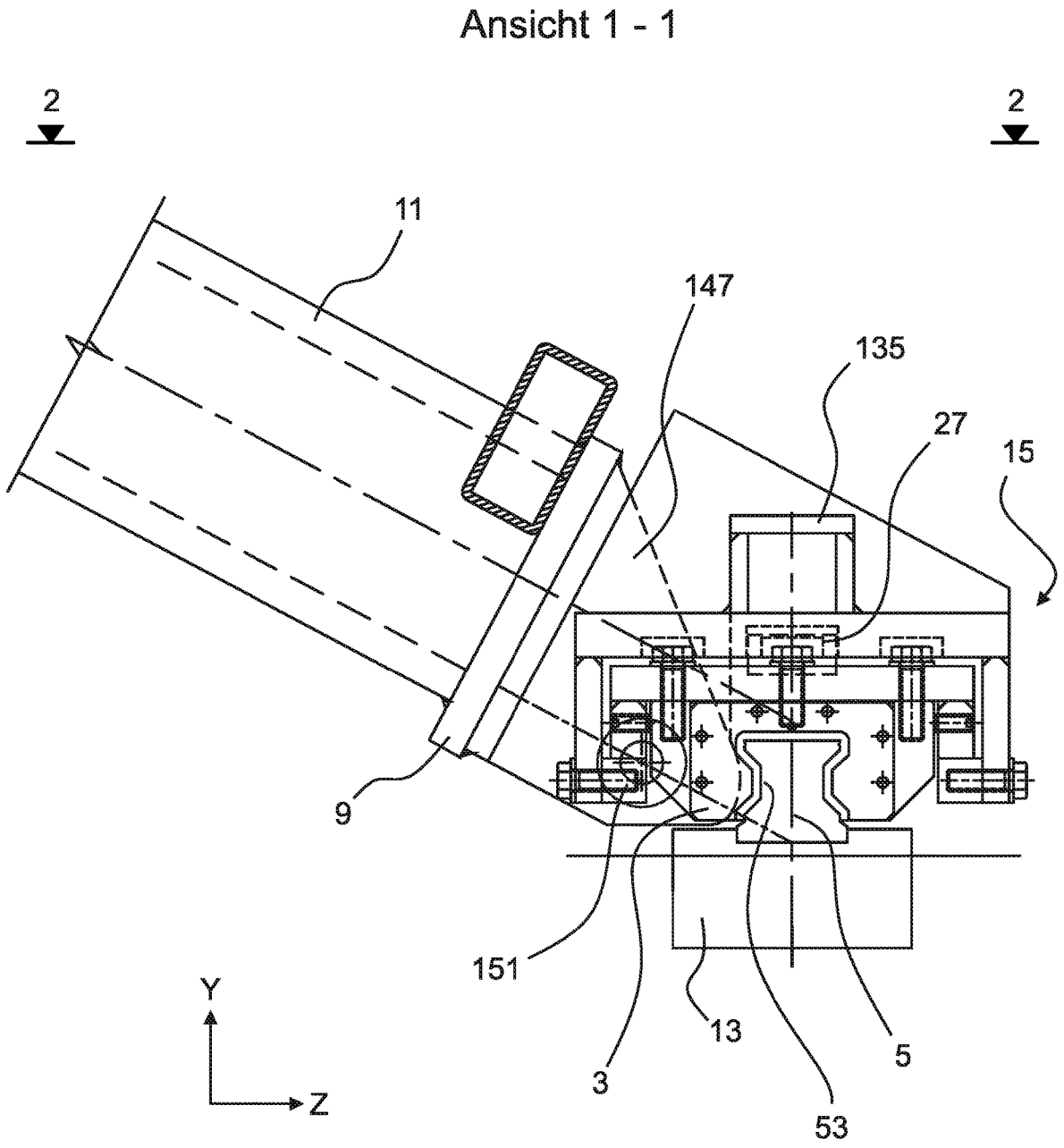
FIGS. 7 through 9 show various views of the exemplary embodiment of the console according to the invention.
Figure 8:
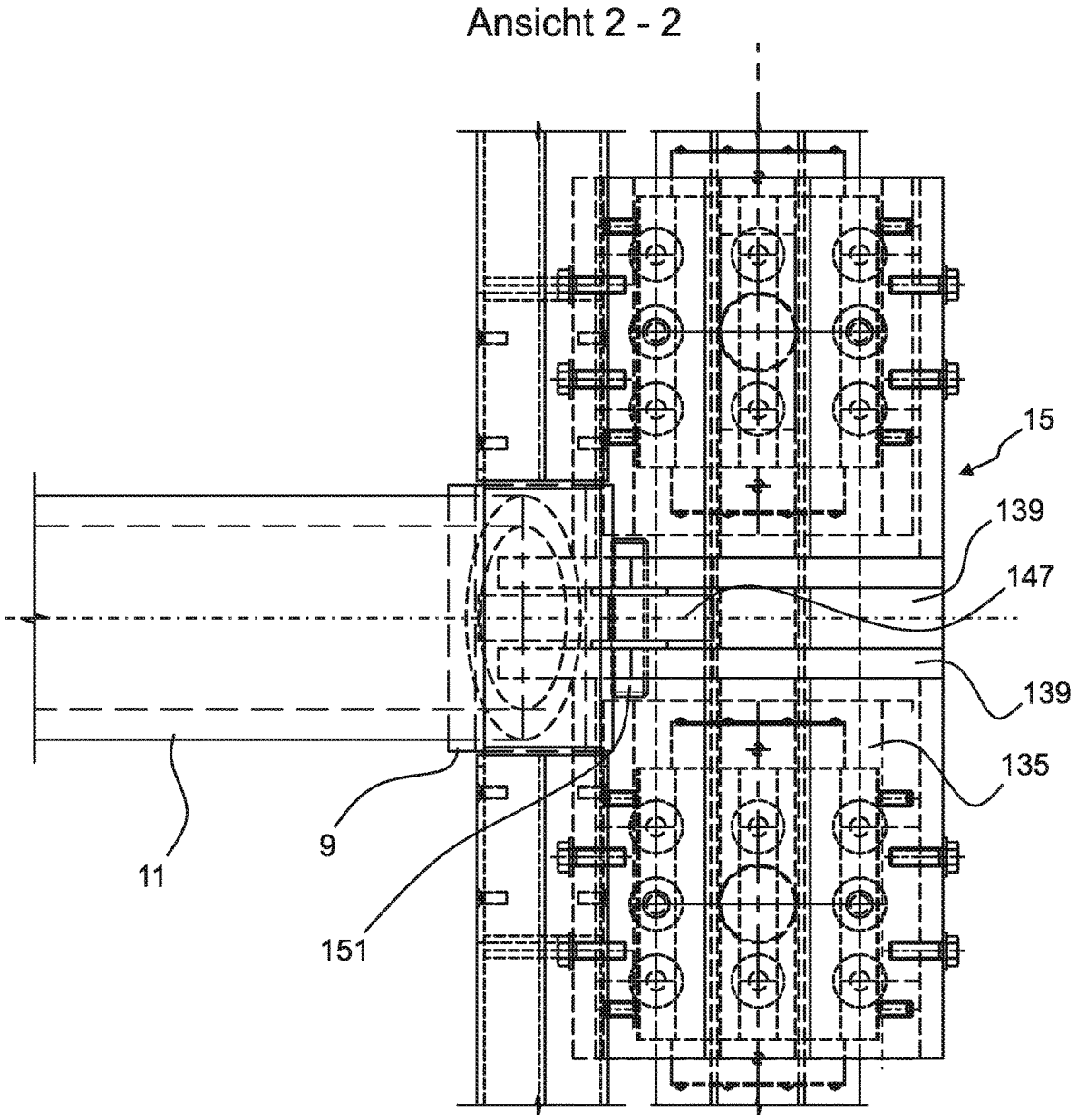
Figure 9:
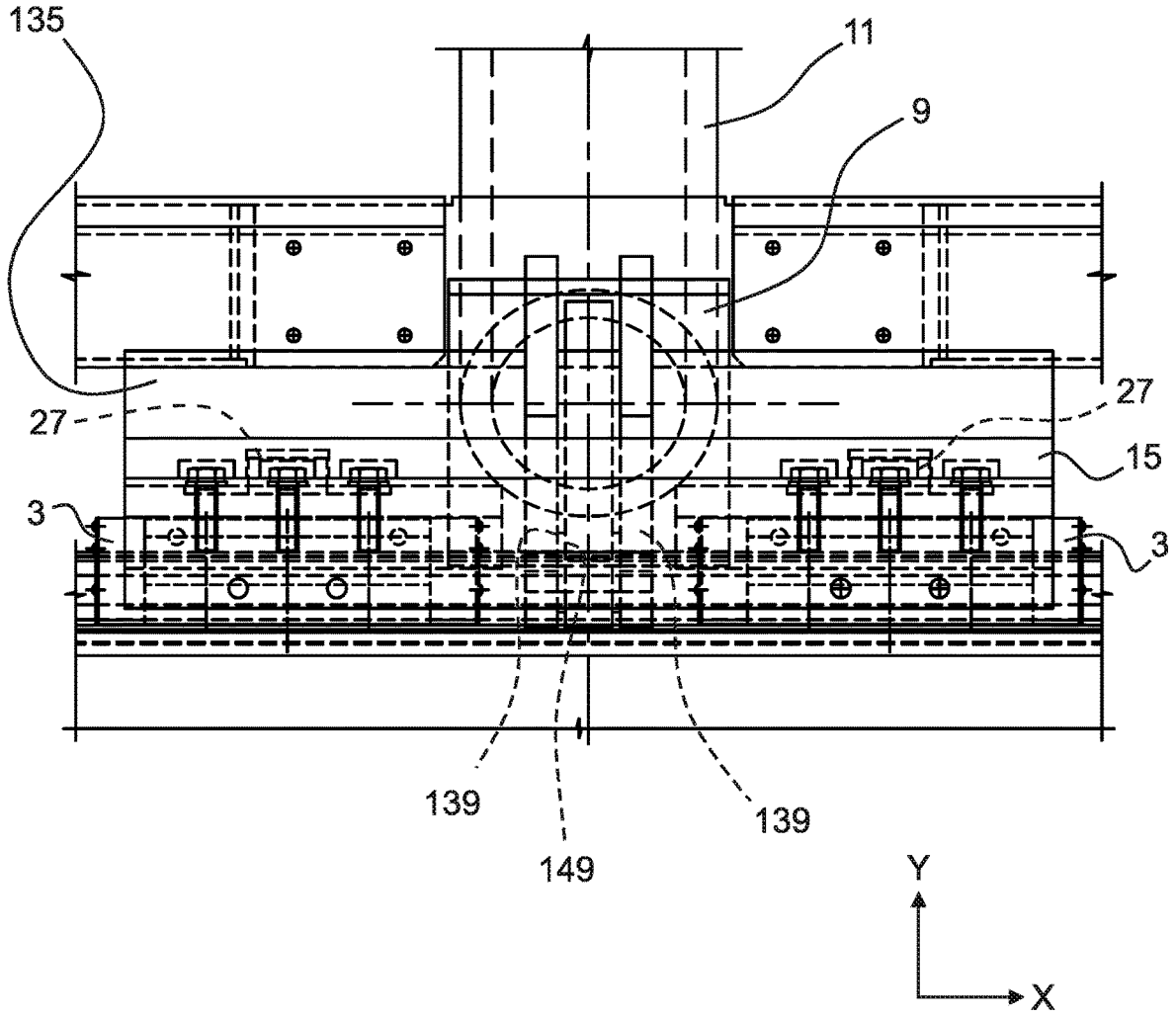

FIGS. 3 through 6 show the individual parts of the second exemplary embodiment. In FIGS. 7 through 9, the exemplary embodiment of a console 1 according to the invention is shown in various views in the assembled state.

Figure 3:
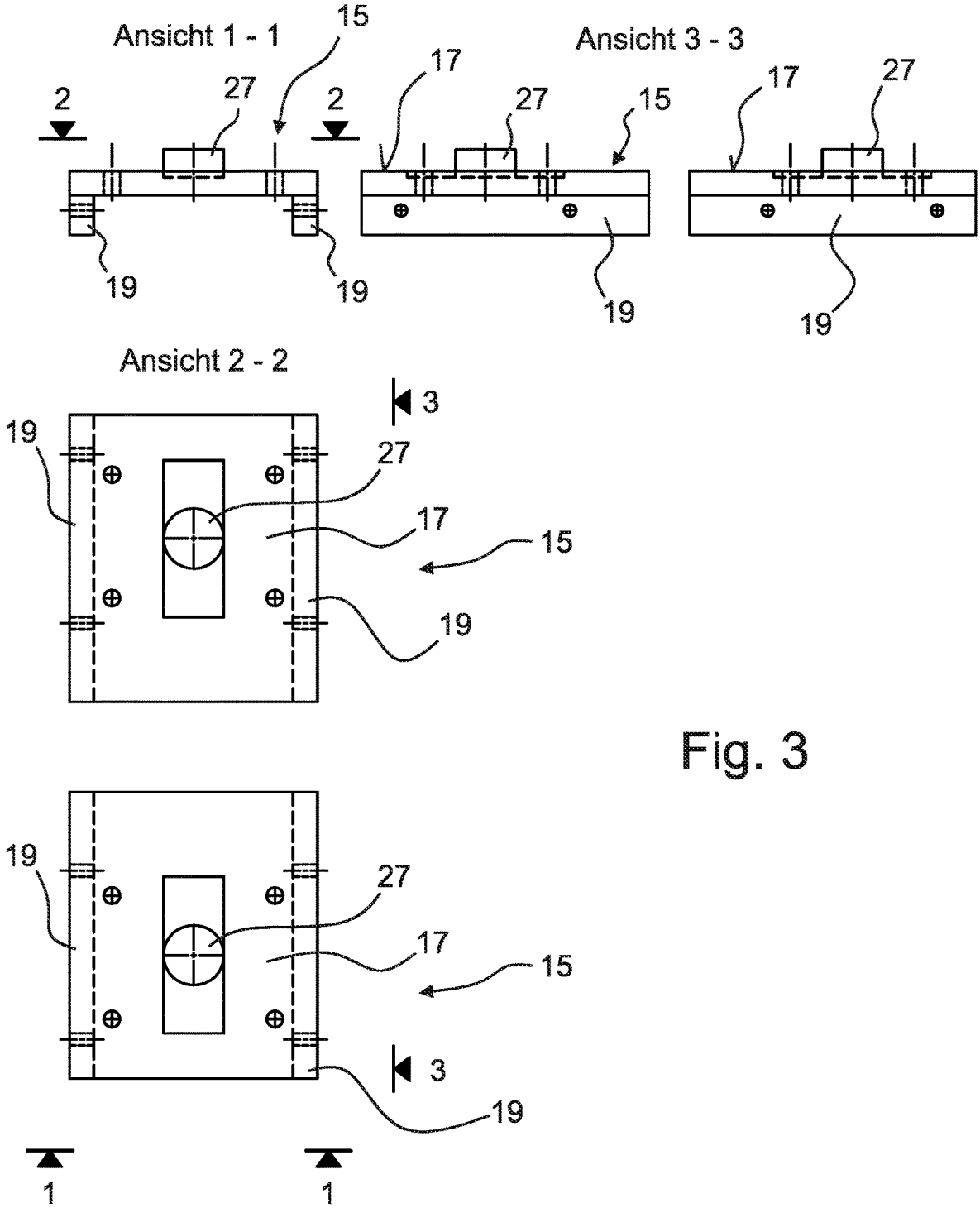
FIGS. 3 through 6 show the most important components of an exemplary embodiment.

FIG. 3 shows both load application plates 15. Both load application plates 15 are each screwed to a carriage 3 (see FIG. 2) by means of several screws. The screws are inserted through the base surface 17 of the load application plate 15 and screwed into the inner thread of the carriage 3 (see FIG. 2). The side surfaces 19 of the load application plate 15 run parallel to the longitudinal direction of the guide rail 5 and parallel to a Y-axis.

In the exemplary embodiment shown, the load application plates 15 with their side surfaces 19 have a U-shaped cross-section. The load application plate 15 and the side surfaces 19 generally consist of three steel plates which are welded to one another.

A bearing pin 27 is fastened to its base surface 17 approximately in the middle of the load application plates 15. This can take place via a press fit and/or weld seams (not shown), or in another way.

Figure 4:
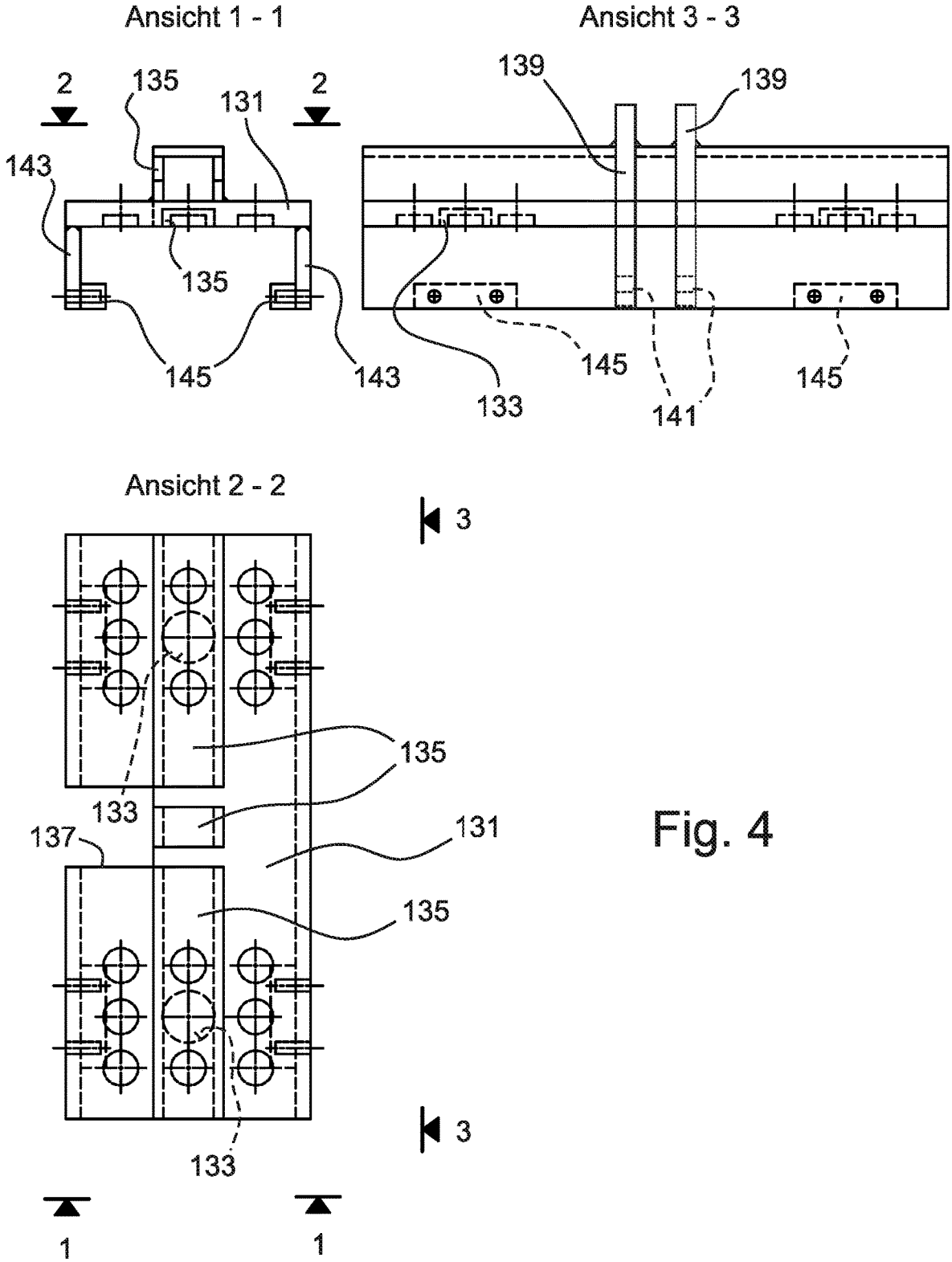

A connection plate 131 according to the invention is shown in various views in FIG. 4. The connection plate 131 serves to establish a connection between the two load distribution plates 15 on the two carriages 3.

For this purpose, the connection plate 131 on its underside has two recesses 133 which with the pins 27 form a bearing on the base of the load distribution plates 15. The axis of rotation of these bearings runs in the direction of the Y-axis (i.e., generally parallel to a normal vector of the load distribution plates 15). The carriages 3 with the load distribution plates 15 and the rotary bearings then act similarly to the bogie of a locomotive. The rotary bearings prevent tensions between the carriages 3. This relieves the linear guide and increases its service life.

A stiffening or reinforcement 135 is welded to the upper side of the connection plate 131. The reinforcement 135 has a U-shaped cross-section and can be produced by welding three steel plates.

In the view from above (view 2-2) of FIG. 4, it is clear that the connection plate 130 has a recess 137 approximately in the middle. In this region, the reinforcement 135 is also interrupted twice. Where the reinforcement 135 is interrupted, second bearing plates 139 (see FIG. 5) are welded in. These second bearing plates 139 are shown only in view 3-3. In the views 1-1 and 2-2 of FIG. 4, the second bearing plates 139 are not shown.

Figure 5:
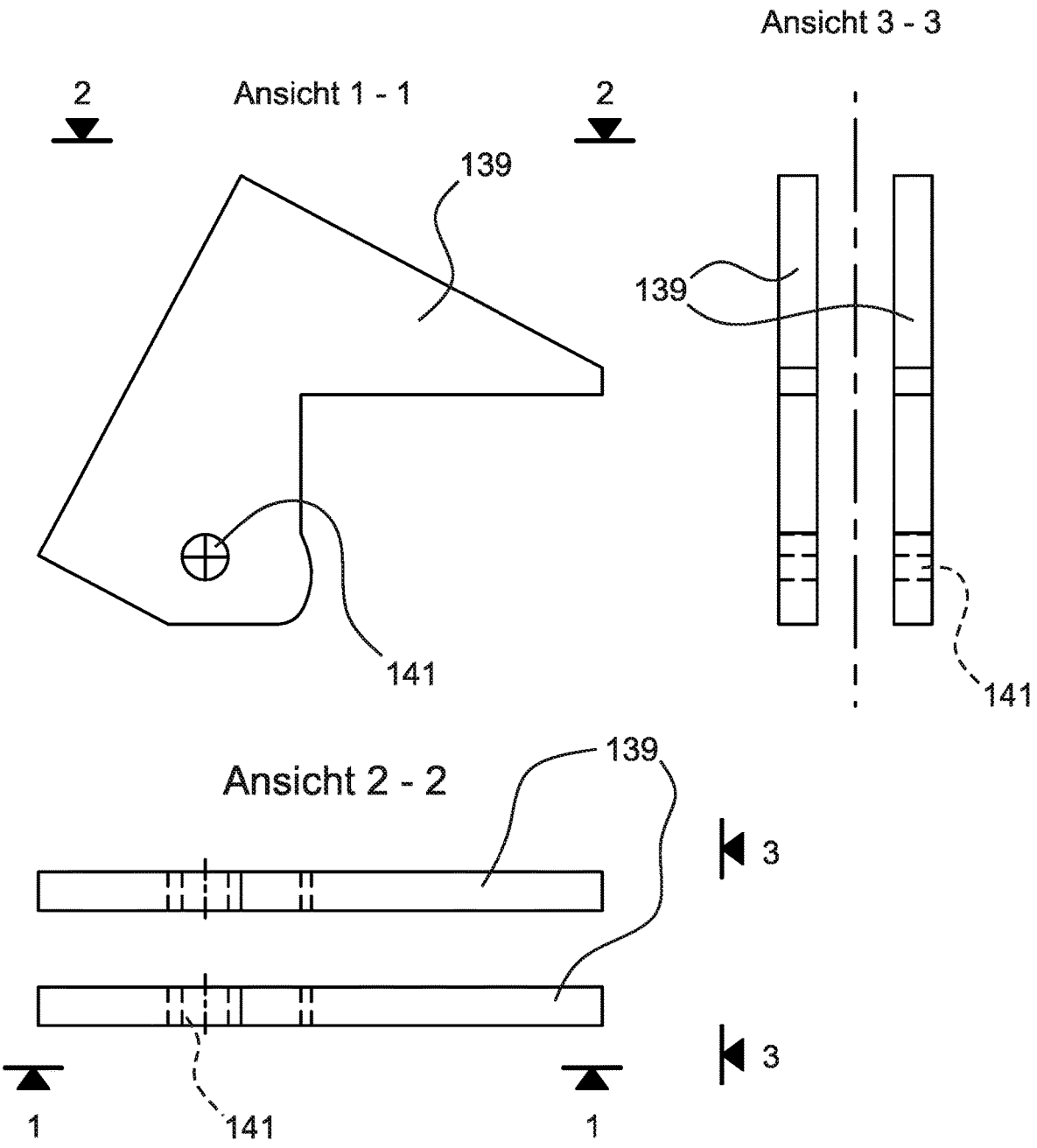

The second bearing plates 139 are shown in FIG. 5. They each have a bearing bore 141 which forms a bearing channel for a bearing pin.

As can be seen from FIG. 7, the bearing bores 141 or the bearing channel formed by them are located beneath the connection plate 131 approximately at the height of the bearing region 53 of the rail 5 (see FIG. 2).

From the view 1-1 of FIG. 4, it is clear that in this exemplary embodiment the connection plate 131 has a U-shaped cross-section. The side walls are denoted by the reference sign 143. Retaining strips 145 are screwed onto the—in the view 1-1—lower end of the side walls 143. In the assembled state, the retaining strips 145 surround the carriage 3 or the load distribution plates 15 on the carriage 3 in a positive manner. This positive connection ensures that the connection plate 131 (and the roof or facade part fastened thereto) cannot lift off from the load distribution plates 15. This can be of great importance if large wind forces (e.g., during a storm) act upon the roof or the facade. The rotary bearings between the connection plate 131 and the load application plates 15 would not be able to reliably transmit these forces.

Figure 6:
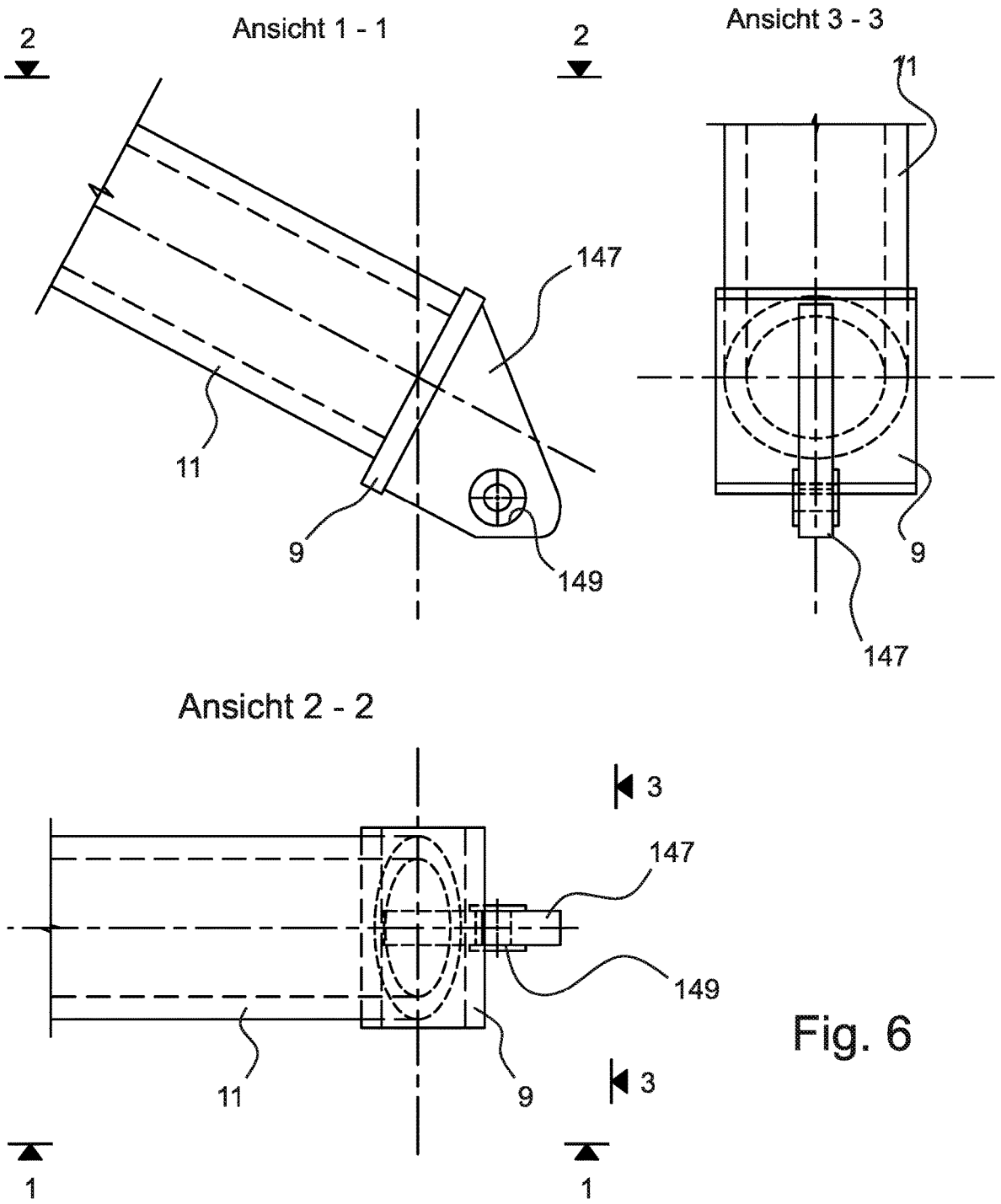

A support 11 having a first bearing plate 147 is shown in FIG. 6. The support 11 is part of the retractable roof or the retractable facade.

In this exemplary embodiment, the first bearing plate 147 is welded to a flange 9 and has a bearing bore 149. In the assembled state, the first bearing plate 147 is inserted between the two bearing plates 139 shown in FIG. 4; the bearing bore 149 is part of the bearing channel already mentioned. A bearing pin is inserted into the bearing bores 141 and 149. This results in a very resilient rotary bearing.

The point of rotation of this bearing is relatively far below—approximately at the height of the bearing region 53 of the guide rail 5. The tilting moments which act upon the carriages 3 are thereby significantly reduced. This results primarily from FIG. 7. The bearing pin is there denoted by the reference sign 151.

As can be seen from FIG. 7, the bearing pin 151, and with it the rotary bearing between the support 11 and the console 1, is located approximately at the height of the bearing region 53 of the guide rail 5. This means that the rolling elements of the carriages 3 have to transmit predominantly weight forces, i.e., forces in the direction of the negative Y-axis, and horizontal forces, i.e., forces in the direction of the Z-axis.

Due to the arrangement according to the invention of the bearing (141, 149, 151), the tilting moments acting upon the carriages 3 are reduced to a minimum. As a result, the generally cylindrical rolling elements (not shown) in the carriage 3 are loaded very uniformly over their entire lengths. This significantly increases—given otherwise equivalent boundary conditions—the service life of the linear guide.

In the embodiment shown, there are several bearings. The two first bearings about the bearing pin 27 enable compensating movements about the Y-axis. The second bearing is defined by the bearing pin 151. The axis of rotation of this second bearing runs in the direction of the X-axis, i.e., parallel to the rail 5.

In this exemplary embodiment, the desired degrees of freedom are made possible by the structural design of the components. The transmission of weight forces and dynamic loads to the carriages 3 takes place in a very favorable manner. In addition, in this embodiment, the loads are introduced into the guide rail 5 via two carriages 3 spaced apart from one another. This also relieves the load on the guide rail 5 and the support structure 13.

LIST OF REFERENCE SIGNS

1 console
3 carriage
5 guide rail
7 rib,
9 flange
11 support of the roof/facade
13 support structure
15 load application plate
17 base
19 side surface
27 bearing pin
31 first bearing plate
131 connection plate

133 recess
135 reinforcement
137 recess
139 first bearing plate
141 bearing bore
143 side wall
145 retaining strip
147 second bearing plate
149 bearing bore
151 bearing pin

What is claimed is:

1. A support for movable roofs and facades comprising two load-introduction plates, a connection plate, and a mechanical interface, wherein the connection plate is rotatably connected to each of the load-introduction plates by means of a respective first rotary bearing, wherein the mechanical interface comprises at least one first bearing plate with a bearing bore, at least one second bearing plate having a bearing bore, the second bearing plate being disposed on the connection plate, and a bearing pin, wherein an axis of rotation of a second rotary bearing formed by the bearing bores and the bearing pin runs parallel to a direction of travel (X-direction) of the support.

2. The support according to claim 1, characterized in that the first rotary bearings between the connection plate and a load application plate comprise a bearing pin and a recess interacting with the bearing pin, and in that the axes of rotation of the first rotary bearings formed thereby run orthogonally to a direction of travel (X-direction) of the support.

3. The support according to claim 1, characterized in that the connection plate has a recess approximately in its center, in that the at least one second bearing plate is arranged on the connection plate in such a way that the bearing bore(s) is positioned beneath the connection plate.

4. The support according to claim 1, characterized in that the connection plate has a reinforcement on its upper side, and in that the at least one second bearing plate is connected to the reinforcement.

5. The support according to claim 1, characterized in that the first bearing plate at its end opposite the bearing bore is connected to a support or a flange plate.

6. The support according to claim 1, characterized in that the connection plate has two side walls, in that at least one retaining part is releasably fastened to the side walls, and in that the retaining part or parts surrounds or surround at least one of the load-introduction plates.

7. The support according to claim 1, characterized in that the load-introduction plate is part of a linear guide, and in that the linear guide comprises one or more carriages and a guide rail.

8. The support according to claim 7, characterized in that the in each case one load-introduction plate is releasably connected to a carriage of the linear guide.

* * * * *